US009405264B2

(12) United States Patent
Ishiwata

(10) Patent No.: US 9,405,264 B2
(45) Date of Patent: Aug. 2, 2016

(54) FALL PREVENTION DEVICE AND IMAGE FORMING APPARATUS

(75) Inventor: Kiyohide Ishiwata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 127 days.

(21) Appl. No.: 13/457,194

(22) Filed: Apr. 26, 2012

(65) Prior Publication Data

US 2013/0112822 A1 May 9, 2013

(30) Foreign Application Priority Data

Nov. 4, 2011 (JP) ..... 2011-241914

(51) Int. Cl.
*F16M 11/24* (2006.01)
*G03G 21/16* (2006.01)
*A47B 91/08* (2006.01)

(52) U.S. Cl.
CPC ..... *G03G 21/1619* (2013.01); *A47B 91/08* (2013.01)

(58) Field of Classification Search
CPC .. A47B 91/08; A47B 2097/008; A47B 91/10; G03G 21/1619
USPC ..... 248/500, 499, 506, 680, 501, 248/188.8–188.91, 188, 677, 638, 505, 507, 248/510, 673, 502; 52/167.1, 167.4
See application file for complete search history.

(56) References Cited

U.S. PATENT DOCUMENTS 1,450,183 A * 4/1923 Moon ..... A47B 21/04 248/680
2,304,311 A * 12/1942 Luce ..... B60Q 1/0433 248/309.1
5,131,621 A * 7/1992 Sdano ..... F16M 7/00 248/500
5,624,098 A * 4/1997 McDowell ..... F24C 3/12 248/188.8
5,699,993 A * 12/1997 Hill ..... H02B 1/54 248/316.5

(Continued)

FOREIGN PATENT DOCUMENTS

EP 0834628 A2 4/1998
JP 10262759 A 10/1998

(Continued)

OTHER PUBLICATIONS

Office Action issued by Australian Patent Office in corresponding Australian Patent application No. 2012203127, dated Jul. 31, 2013.

(Continued)

*Primary Examiner* — Christopher E Garft
(74) *Attorney, Agent, or Firm* — Sughrue Mion, PLLC

(57) ABSTRACT

Provided is a fall prevention device that prevents an installation object from falling over by supporting a leg member including a base portion and a shaft portion when an installation surface oscillates. The fall prevention device includes a support portion supported by the installation surface, a first restricting portion supported by the support portion, correspondingly disposed above an upper surface of a base portion, and having a first shaft-penetrating portion through which a shaft portion penetrates, and a second restricting portion disposed above the first restricting portion at a bottom-portion-side end portion of the shaft portion. The second restricting portion has a second shaft-penetrating portion through which the shaft portion penetrates. A gap that is smaller than a gap between the first shaft-penetrating portion and the shaft portion is formed between the second shaft-penetrating portion and the end portion of the shaft portion.

18 Claims, 8 Drawing Sheets

(56) References Cited

U.S. PATENT DOCUMENTS

| | | | | |
|---|---|---|---|---|
| 6,409,129 | B1 * | 6/2002 | Chen | A47B 91/024 248/188.8 |
| 7,775,498 | B2 * | 8/2010 | Phillips | A47L 15/4253 248/500 |
| 2002/0014573 | A1 * | 2/2002 | Anderson | F16M 7/00 248/677 |

FOREIGN PATENT DOCUMENTS

| | | | |
|---|---|---|---|
| JP | 2000378481 | A | 6/2002 |
| JP | 2003-089462 | A | 3/2003 |
| JP | 2003-089463 | A | 3/2003 |
| JP | 2011-010691 | A | 1/2011 |

OTHER PUBLICATIONS

Japanese Unexamined Patent Application Publication No. 2011-10691.

Japanese Unexamined Patent Application Publication No. 2003-089462.

Japanese Unexamined Patent Application Publication No. 2003-089463.

* cited by examiner

FALL PREVENTION DEVICE AND IMAGE FORMING APPARATUS

CROSS-REFERENCE TO RELATED APPLICATIONS

This application is based on and claims priority under 35 USC 119 from Japanese Patent Application No. 2011-241914 filed Nov. 4, 2011.

BACKGROUND

The present invention relates to a fall prevention device and an image forming apparatus.

SUMMARY

To address the above technical object, according to an aspect of the present invention, a fall prevention device is provided that prevents an installation object from falling over by supporting a leg member including a base portion and a shaft portion when an installation surface oscillates, the base portion being in contact with the installation surface, the shaft portion connecting the base portion and a bottom portion of the installation object to each other and having a diameter that is smaller than a diameter of the base portion. The fall prevention device includes a support portion that is supported by the installation surface, a first restricting portion that is supported by the support portion and disposed above an upper surface of the base portion so as to correspond to the upper surface, the first restricting portion having a first shaft-penetrating portion through which the shaft portion penetrates, and a second restricting portion that is disposed above the first restricting portion so as to correspond to an end portion of the shaft portion on a side that is adjacent to the bottom portion, the second restricting portion having a second shaft-penetrating portion through which the shaft portion penetrates, the second restricting portion being formed such that a gap that is smaller than a gap between the first shaft-penetrating portion and the shaft portion is formed between the second shaft-penetrating portion and the end portion of the shaft portion.

BRIEF DESCRIPTION OF THE DRAWINGS

Exemplary embodiments of the present invention will be described in detail based on the following figures, wherein:

FIG. 4A is a perspective diagram of the fall prevention device, FIG. 4B illustrates the fall prevention device seen in the arrow IVB direction of FIG. 4A, and FIG. 4C illustrates the fall prevention device seen in the arrow IVC direction of FIG. 4B;

FIG. 6A illustrates an exemplary state where the adjusting devices are attached to the fall prevention device according to the first exemplary embodiment, FIG. 6B is a perspective diagram of one of the adjusting devices, and FIG. 6C illustrates an adjusting device according to a modification of the adjusting device illustrated in FIG. 6B;

FIG. 7A illustrates a state of a fall prevention device of the related art when an installation surface oscillates vertically, FIG. 7B illustrates a state of the fall prevention device of the related art when the installation surface oscillates laterally, FIG. 7C illustrates a state of the fall prevention device according to the first exemplary embodiment when the installation surface oscillates vertically, and FIG. 7D illustrates a state of the fall prevention device according to the first exemplary embodiment when the installation surface oscillates laterally.

DETAILED DESCRIPTION

Figure 1:
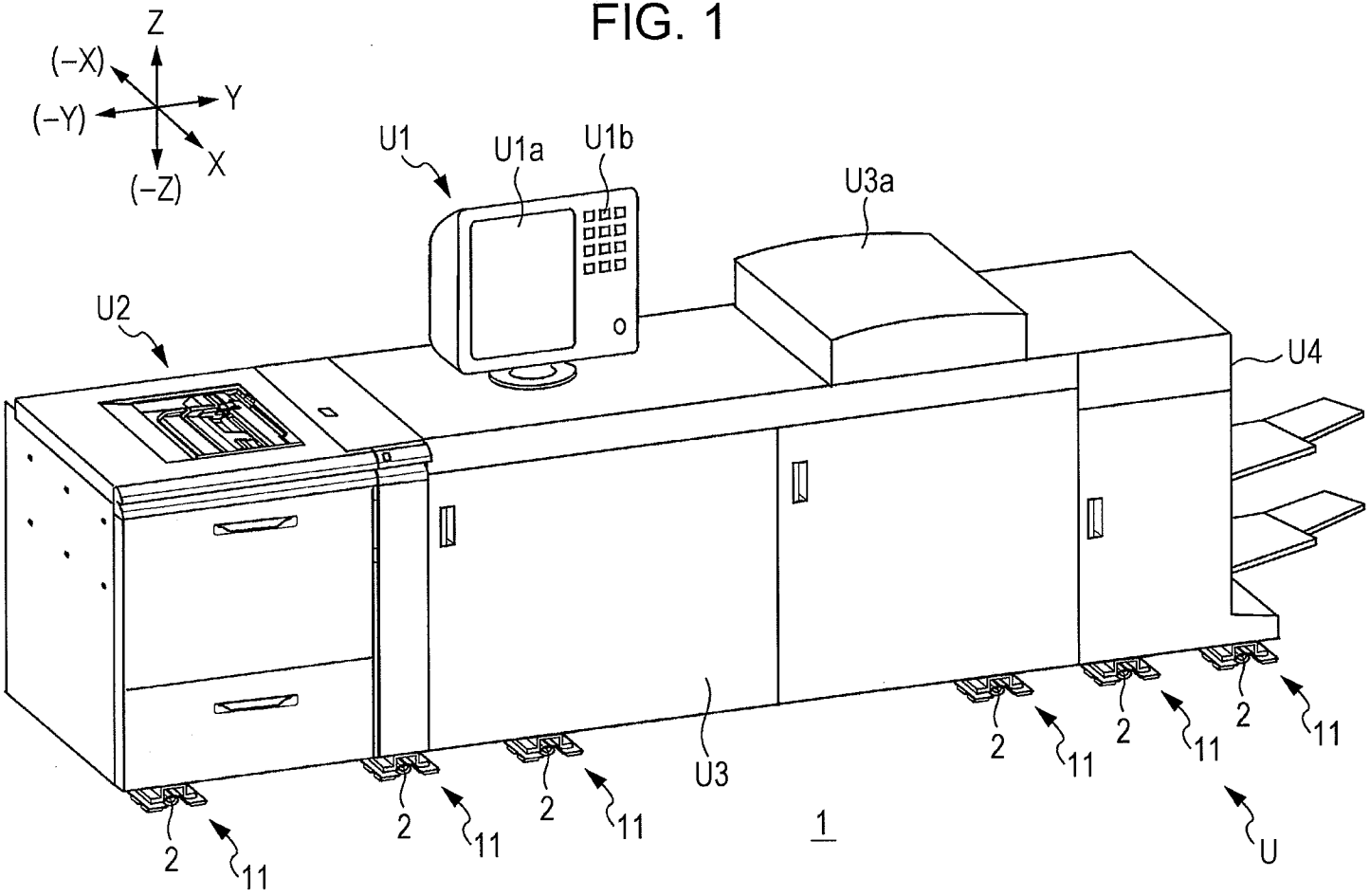
FIG. 1 is a perspective diagram of an image forming apparatus according to a first exemplary embodiment of the present invention.

Referring to the drawings, exemplary embodiments of the present invention will be described. The present invention is, however, not limited to the exemplary embodiments described below.

For ease of understanding the following description, in the drawings, the X axis indicates front-rear directions, the Y axis indicates right-left directions, and the Z axis indicates up-down directions. Directions or sides indicated by X, −X, Y, −Y, Z, and −Z arrows are respectively expressed as frontward, rearward, rightward, leftward, upward, and downward, or front, rear, right, left, upper, and lower sides.

In each drawing, a circle having a dot therein denotes an arrow directed from the back surface to the front surface of the sheet of the drawing, and a circle having a cross mark therein denotes an arrow directed from the front surface to the back surface of the sheet of the drawing.

Components other than those provided for ease of understanding the following description made with reference to the drawings are omitted as appropriate.

First Exemplary Embodiment

FIG. 1 is a perspective diagram of an image forming apparatus according to a first exemplary embodiment of the present invention.

Figure 2:
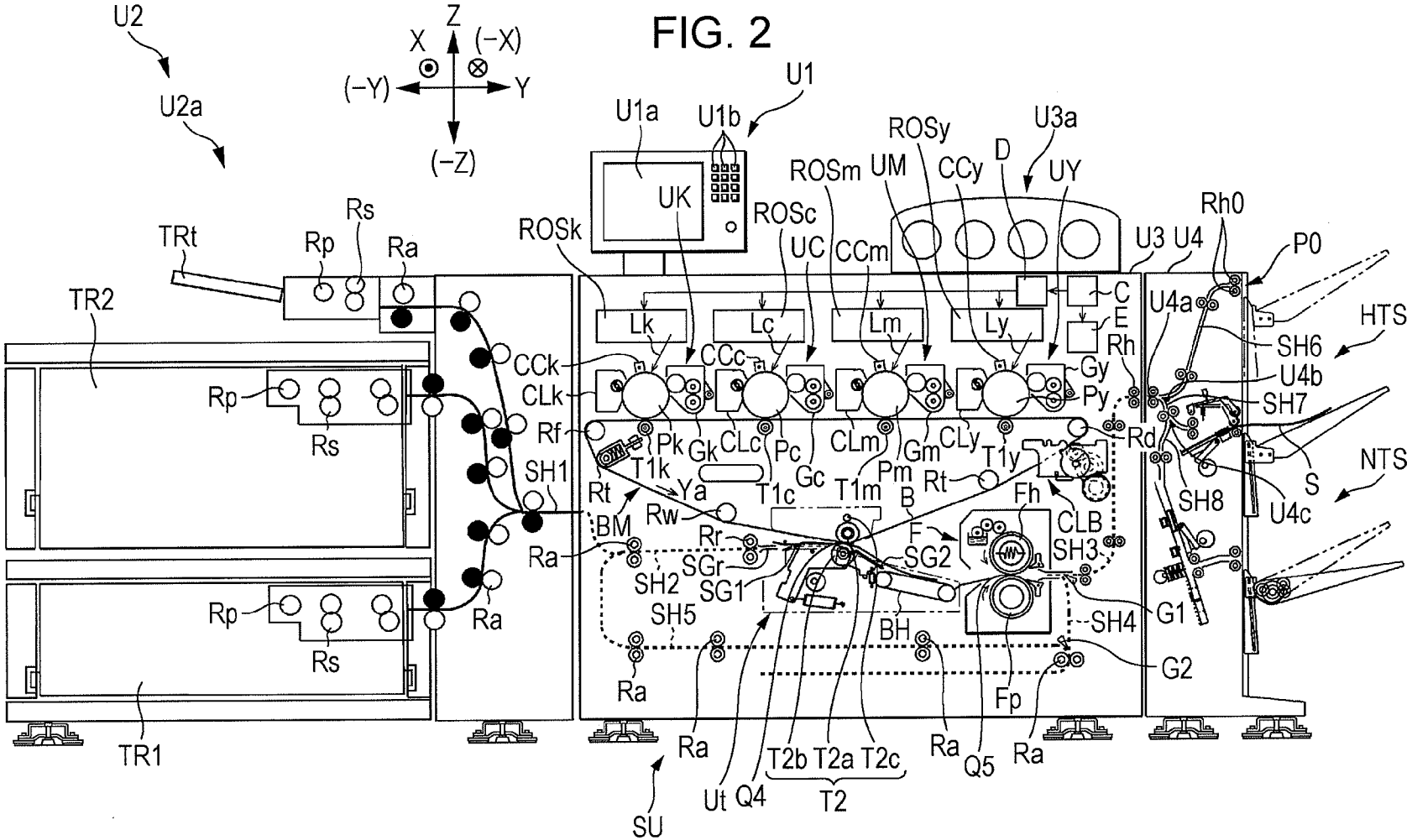
FIG. 2 illustrates the entirety of the image forming apparatus according to the first exemplary embodiment.

FIG. 2 illustrates the entirety of the image forming apparatus according to the first exemplary embodiment.

In FIGS. 1 and 2, a large printer U, which is an example of an image forming apparatus, includes an operating unit U1 that operates the printer U, a paper feeding device U2, an image-forming-apparatus body U3, which is an example of an image recording device, and a postprocessing device U4.

The operating unit U1 includes a display U1*a*, which displays information, and input buttons U1*b*, through which various settings for the image forming apparatus are made.

The paper feeding device U2 includes paper feed trays TR1 and TR2, which are examples of a medium containing unit. The paper feed trays TR1 and TR2 contain sheets S, which are examples of a medium, and are supported by the paper feeding device U2 so as to be capable of being inserted into and drawn from the paper feeding device U2 in the front-rear directions. Sheets S contained in the paper feed tray TR1 or TR2 are picked up by a pick-up roller Rp, which is an example of a pick-up member, and are separated into individual sheets by separation rollers Rs, which are examples of a separating member. The sheets S separated by the separation rollers Rs are fed to the image-forming-apparatus body U3 by transport rollers Ra that are disposed on a paper feed path SH1, which is an example of a transport path. The transport rollers Ra are examples of a transport member.

A manual-feed tray TRt, which is an example of a manual-feed unit, is supported at an upper end portion of the paper feeding device U2. Sheets S contained in the manual-feed tray TRt are transported to the image-forming-apparatus body U3 by a pick-up roller Rp, separation rollers Rs, and transport rollers Ra in the same manner as the sheets S contained in the paper feed trays TR1 and TR2.

In FIG. 2, the image-forming-apparatus body U3 includes a controller C that controls the printer U, a laser driving circuit D, which is an example of a driving circuit for driving latent-image forming devices ROSy, ROSm, ROSc, and ROSk and controlled by the controller C, a power supply circuit E, and other devices. The laser driving circuit D whose operation is controlled by the controller C forms image information of colors including yellow Y, magenta M, cyan C, and black K on the basis of image information transmitted from an information terminal, which is not illustrated. The laser driving circuit D outputs driving signals corresponding to the image information of the colors at a predetermined timing to the latent-image forming devices ROSy, ROSm, ROSc, and ROSk of visible-image forming devices UY, UM, UC, and UK for the different colors. The visible-image forming devices UY, UM, UC, and UK for the different colors are supported so as to be movable between a drawn position, at which the visible-image forming devices UY, UM, UC, and UK are drawn to the front of the image-forming-apparatus body U3, and a mounted position, at which the visible-image forming devices UY, UM, UC, and UK are mounted on the inside of the image-forming-apparatus body U3.

In the visible-image forming device UK for black, a charging device CCk, a developing device Gk, an image carrier cleaner CLk, and other devices are arranged around an image carrier Pk.

In the same manner as in the case of the image carrier Pk, a charging device CCy, CCm, or CCc, a developing device Gy, Gm, or Gc, an image carrier cleaner CLy, CLm, or CLc, and other devices are arranged around the image carrier Py, Pm, or Pc of a corresponding one of the visible-image forming devices UY, UM, and UC.

In FIG. 2, the image carriers Py to Pk are uniformly charged by the charging devices CCy to CCk, and thus electrostatic latent images are formed on the surfaces of the image carriers Py to Pk by latent-image creating light beams Ly, Lm, Lc, and Lk that are emitted by the latent-image forming devices ROSy to ROSk. The electrostatic latent images formed on the surfaces of the image carriers Py to Pk are developed by the developing devices Gy to Gk into visible images, or so-called toner images, of yellow Y, magenta M, cyan C, and black K. When developers contained in the developing devices Gy to Gk are consumed in a developing operation, the developing devices Gy to Gk are replenished with developers from a developer supply device U3*a* disposed on an upper portion of the image-forming-apparatus body U3. Developer supply containers, which are not illustrated and so-called toner cartridges, are supported by the developer supply device U3*a* so as to be detachable and replaceable.

Visible images on the surfaces of the image carriers Py to Pk are transferred to an intermediate transfer belt B, which is an example of an intermediate transfer body, by first transfer members T1*y*, T1*m*, T1*c*, and T1*k*, which are examples of a first transfer device, so as to be sequentially stacked on top of one another. Accordingly, a multicolor image is formed on the intermediate transfer belt B. The multicolor image formed on the intermediate transfer belt B is transported to a second transfer area Q4.

In the case of forming a single-color image, only the image carrier Pk and the developing device Gk for black K are used and thus only a black visible image is formed.

After the first transfer, matters remaining on the surfaces of the image carriers Py to Pk are removed by the image carrier cleaners CLy to CLk to clean the image carriers Py to Pk.

The intermediate transfer belt B is supported by an intermediate-transfer-body driving member Rd, tensioning members Rt, a belt-walk reducing member Rw, multiple driven members Rf, a second-transfer opposing member T2*a*, and the first transfer members T1*y* to T1*k* so as to be rotatable in the arrow Ya direction. In the first exemplary embodiment, the members Rd, Rt, Rw, Rf, T2*a*, and T1*y* to T1*k* are formed of so-called roller members.

A second transfer unit Ut is disposed below a back-up roller T2*a*, which is an example of the second-transfer opposing member. A second transfer member T2*b* of the second transfer unit Ut is disposed so as to be capable of coming into contact with or being separated from the back-up roller T2*a* with the intermediate transfer belt B interposed therebetween. A second transfer area Q4 is an area over which the second transfer roller T2*b* and the intermediate transfer belt B come into contact with and press against each other. In the first exemplary embodiment, a conduction-by-contact member T2*c* is in contact with the back-up roller T2*a*, and a second transfer voltage with the same polarity as the charged voltage of the developer is applied to the conduction-by-contact member T2*c* at a predetermined timing by the power supply circuit E that is controlled by the controller C.

The second-transfer opposing member T2*a*, the second transfer member T2*b*, and the conduction-by-contact member T2*c* constitute the second transfer device T2 according to the first exemplary embodiment. The first transfer members T1*y* to T1*k*, the intermediate transfer belt B, and the second transfer device T2 constitute a transfer device T1*y* to T1*k*+T2+B according to the first exemplary embodiment.

A sheet feeding path SH2, which is an example of a medium feeding path, is disposed below the intermediate transfer belt B. A sheet S fed from the paper feeding device U2 is transported to registration rollers Rr, which are examples of a feed-timing adjusting member, via the transport rollers Ra, which are examples of a medium transport member.

The sheet S having been transported to the registration rollers Rr is transported to the second transfer area Q4 through a prior-to-transfer upstream medium guide member SGr and a prior-to-transfer downstream medium guide member SG1 at the timing when the multicolor image is transported to the second transfer area Q4.

The multicolor image on the intermediate transfer belt B is transferred to a sheet S by the second transfer device T2 when passing through the second transfer area Q4. In the case of the multicolor image, the toner images that have been first-transferred to the surface of the intermediate transfer belt B so as to be stacked on top of one another are collectively second-transferred to the sheet S.

The intermediate transfer belt B is cleaned by an intermediate-transfer-body cleaner CLB after the second transfer. The second transfer member T2*b* and the intermediate-transfer-body cleaner CLB are disposed so as to be capable of coming into contact with and being separated from the intermediate transfer belt B. In the case of forming a multicolor image, the second transfer member T2*b* and the intermediate-transfer-body cleaner CLB are separated from the intermediate transfer belt B until an unfixed visible image of a last color is first-transferred to the intermediate transfer belt B.

A sheet S having had unfixed visible images second-transferred thereto is transported to a fixing device F through a post-transfer medium guide member SG2 and along a medium transport member BH. The fixing device F includes a heating roller Fh, which is an example of a thermally fixing member, and a compression roller Fp, which is an example of a compression fixing member. The sheet S is transported to a fixing area Q5 at which the pair of fixing members Fh and Fp are in contact with each other and press against each other. The unfixed visible images on the sheet S are heated and fixed to the sheet S by the fixing device F when passing through the fixing area Q5. A switching member G1 is disposed downstream of the fixing device F. The switching member G1 selectively switches a path of the sheet S, which has been transported along the sheet feeding path SH2 and heated and compressed at the fixing area Q5, to an output path SH3 or a reverse path SH4. The sheet S having been transported to the output path SH3 is output to the postprocessing device U4 by output rollers Rh, which are examples of an output member.

A circulation path SH5 is connected to the reverse path SH4, and a transport-direction regulating member G2 is disposed at a portion at which the circulation path SH5 is connected to the reverse path SH4. The transport-direction regulating member G2 allows the sheet S having been transported to the reverse path SH4 to pass therethrough once, and then allows the sheet S to be transported in the reverse direction toward the circulation path SH5. The sheet S having been transported to the circulation path SH5 travels along the sheet feeding path SH2 and is transported to the transfer area Q4 again.

The paths SH2, SH3, SH4, and SH5 constitute a medium transport path SH. The path SH, the rollers Ra, Rr, and Rh, and the members SG1, SG2, SGr, BH, G1, and G2 constitute a medium transport device SU.

Description of Postprocessing Device U4 According to First Exemplary Embodiment In FIG. 2, the postprocessing device U4 includes a medium entrance U4*a* into which the sheet S having had images recorded thereon by the image-forming-apparatus body U3 is inserted. The medium entrance U4*a* is disposed on a surface of the postprocessing device U4 that is connected to the image-forming-apparatus body U3. The sheet S that is inserted into the medium entrance U4*a* is transported to either an upper-end output path SH6, which extends upward to the right, or a first postprocessing transport path SH7, which extends downward, with a switching operation performed by a first switching member U4*b*. A second postprocessing transport path SH8 is connected to the first postprocessing transport path SH7. The sheet S is transported to either the first postprocessing transport path SH7 or the second postprocessing transport path SH8 with a switching operation performed by a second switching member U4*c*, which is disposed at a portion at which the second postprocessing transport path SH8 is connected to the first postprocessing transport path SH7.

The sheet S having been transported to the upper-end output path SH6 is output from an upper-end output slot PO by upper-end output members Rh0 without being subjected to postprocessing.

An edge binding device HTS is disposed downstream of the first postprocessing transport path SH7. The edge binding device HTS allows multiple sheets S to be stacked thereon and aligns the multiple sheets S in order to perform an edge-binding operation. For example, the edge binding device HTS forms a binding hole at an end portion of a bundle of the sheets S, binds the bundle of the sheets S by stapling the bundle with an angular U-shaped staple, or outputs the sheets S after aligning the sheets S and without binding the sheets S.

A center-binding device NTS is disposed downstream of the second postprocessing transport path SH8. The center-binding device NTS allows multiple sheets S to be stacked thereon and aligns the multiple sheets in order to perform a center-binding operation. For example, the center-binding device NTS binds a bundle of the sheets S by stapling the bundle with an angular U-shaped staple at an center portion of the bundle, folds the bundle in half, and then outputs the bundle, or folds the bundle in half and then outputs the bundle without binding the bundle.

Since the edge binding device HTS and the center-binding device NTS have been publicly known, they are not described in detail here.

Description of Leg Member and Fall Prevention Device

Figure 3:
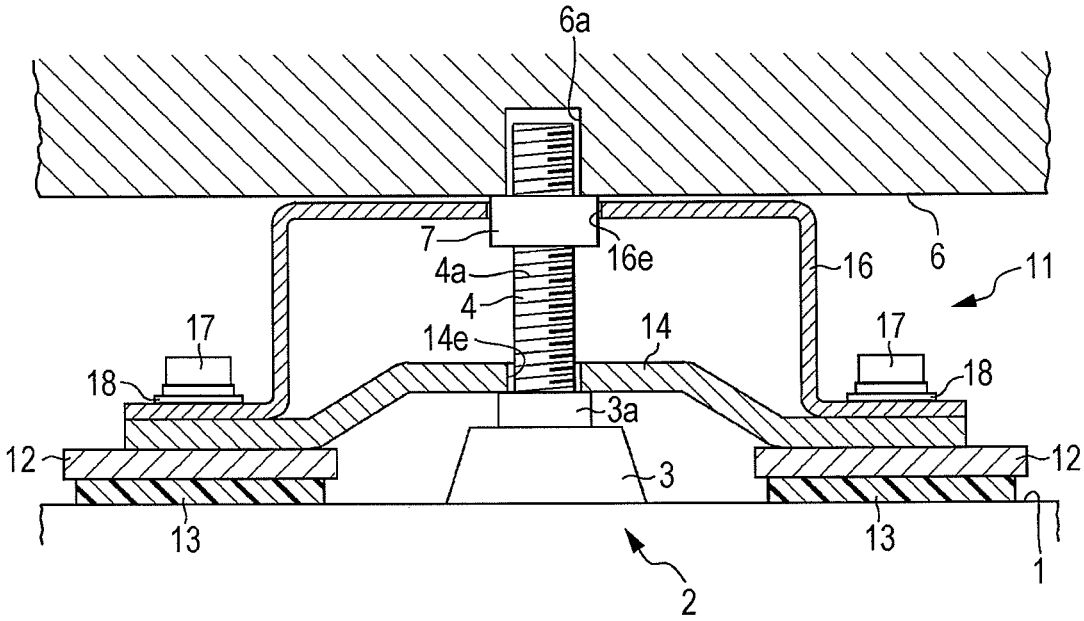
FIG. 3 is a simplified diagram of a leg member and a fall prevention device according to the first exemplary embodiment.

FIG. 3 is a simplified diagram of a leg member and a fall prevention device according to the first exemplary embodiment.

In FIGS. 1 and 2, in the printer U according to the first exemplary embodiment, feet 2, which are examples of a leg member supported by a floor 1, are supported at bottom portions of the paper feeding device U2, the image-forming-apparatus body U3, and the postprocessing device U4, which are examples of the installation object. The floor 1 is an example of an installation surface.

In FIGS. 2 and 3, each foot 2 according to the first exemplary embodiment includes a truncated base portion 3 that is supported by the floor 1. A lower nut 3*a* having a thread groove, which is not illustrated, formed on an inner side thereof is supported on an upper surface of the base portion 3. The lower nut 3*a* is an example of a connecting member.

A rod-like shaft portion 4 that extends upward is disposed on an upper portion of the base portion 3. A screw thread 4*a*, which is an example of an adjusting portion, is formed on an outer peripheral surface of the shaft portion 4 according to the first exemplary embodiment. A lower end portion of the shaft portion 4 is screwed into the thread groove of the lower nut 3*a* to join the shaft portion 4 and the base portion 3 together.

A body nut 7, which is an example of an adjustable member, is supported by a bottom surface 6 of each of the paper feeding device U2, the image-forming-apparatus body U3, and the postprocessing device U4 according to the first exemplary embodiment. The body nut 7 has a thread groove, which is not illustrated, through which the shaft portion 4 is capable of being inserted and which engages with the screw thread 4*a*. A recessed portion 6*a* that is recessed upward or inward from the bottom surface 6 is formed in each of the paper feeding device U2, the image-forming-apparatus body U3, and the postprocessing device U4 according to the first exemplary embodiment so as to be disposed above the body nut 7. The recessed portion 6*a* is capable of accommodating an upper end portion of the shaft portion 4 that penetrates the body nut 7.

When the paper feeding device U2, the image-forming-apparatus body U3, and the postprocessing device U4 are each to be installed on the floor 1, the paper feeding devices U2, the image-forming-apparatus body U3, and the postprocessing device U4 are each vertically shifted by rotating each foot 2 about the shaft portion 4 to cause the screw thread 4*a* to be screwed into the thread groove of the body nut 7. In this manner, the distance between the bottom surface 6, which supports the body nut 7, and the bottom surface of the base portion 3 is made adjustable. In short, the height of each foot 2 is adjustable by rotating the foot 2 in accordance with the height of the floor 1, which may include a step or roughness.

Figure 4A:
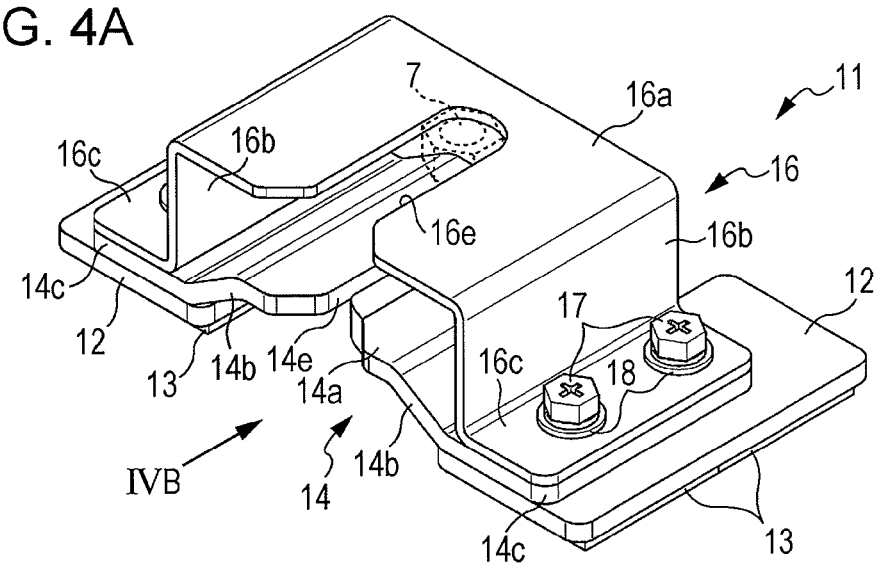
FIGS. 4A to 4C illustrate the fall prevention device according to the first exemplary embodiment.
Figure 4B:
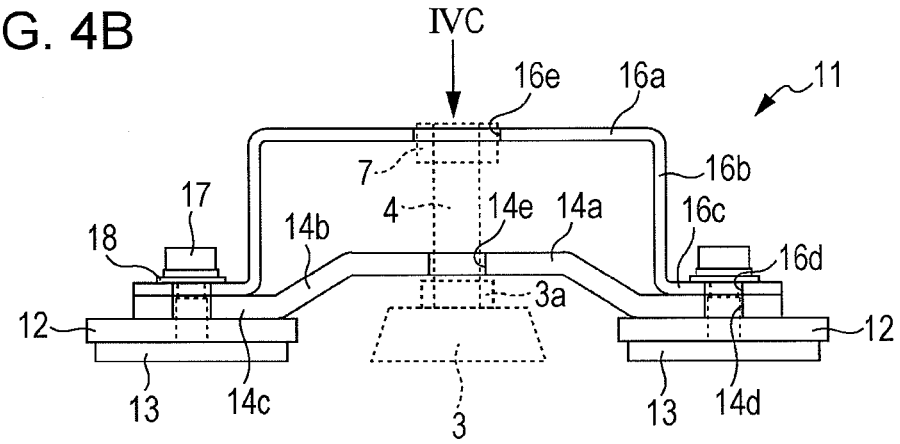
Figure 4C:
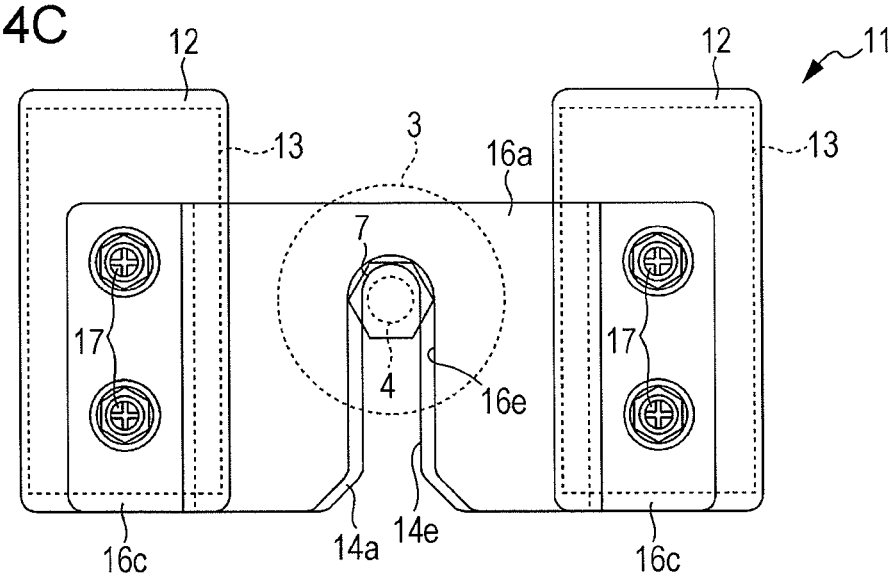

FIGS. 4A to 4C illustrate the fall prevention device according to the first exemplary embodiment, FIG. 4A is a perspective diagram of the fall prevention device, FIG. 4B illustrates the fall prevention device seen in the arrow IVB direction of FIG. 4A, and FIG. 4C illustrates the fall prevention device seen in the arrow IVC direction of FIG. 4B.

Figure 5:
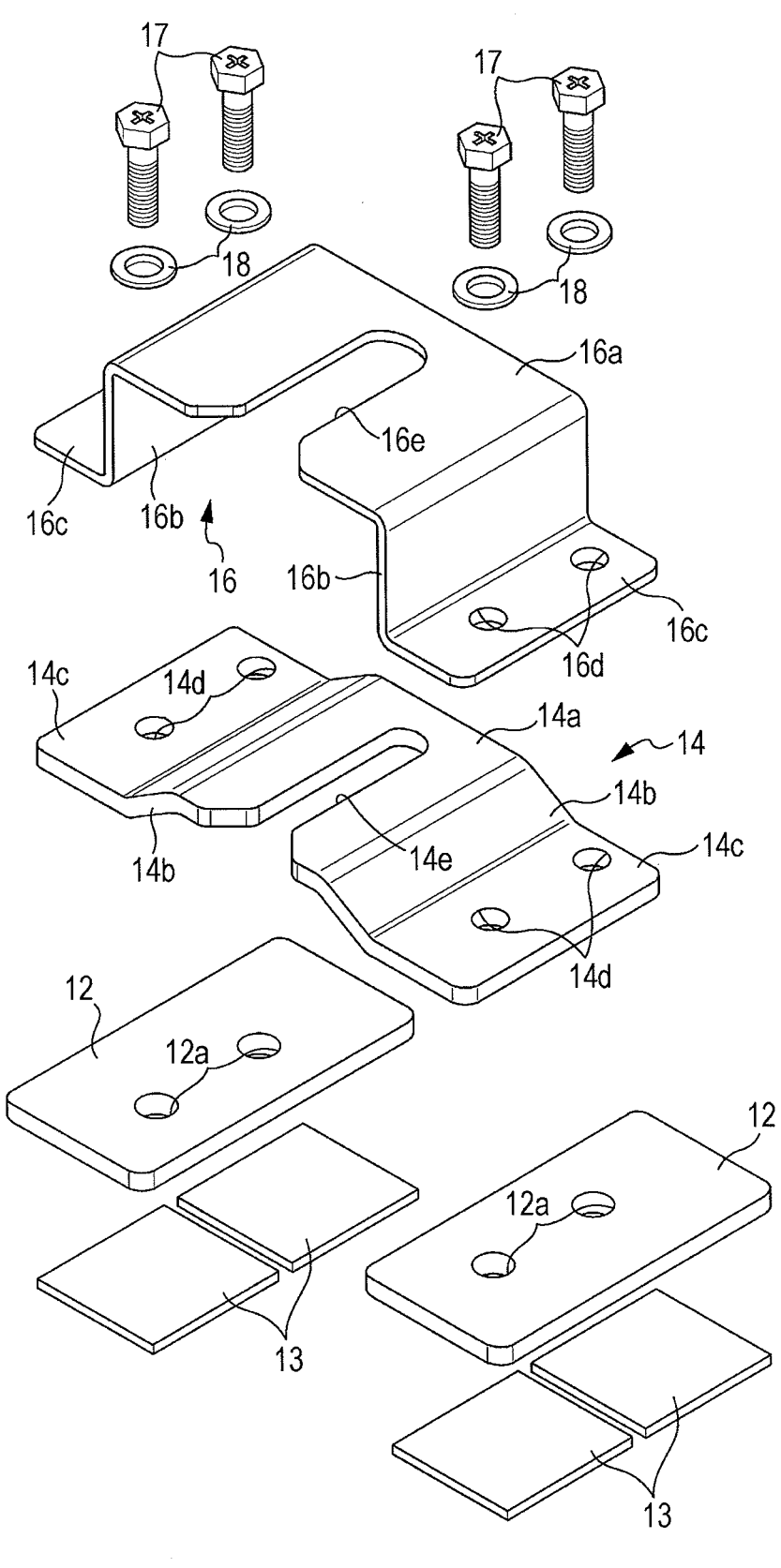
FIG. 5 is an exploded diagram of the fall prevention device illustrated in FIG. 4A.

FIG. 5 is an exploded diagram of the fall prevention device illustrated in FIG. 4A.

In FIGS. 3, 4B, and 4C, an earthquake-proof bracket 11, which is an example of a fall prevention device, is fitted on the foot 2. In FIGS. 3 to 5, the earthquake-proof bracket 11 according to the first exemplary embodiment includes a pair of right and left bottom plates 12, which are examples of a support portion that is supported by the floor 1. Each bottom plate 12A has a pair of front and rear screw holes 12*a* formed therein, which are examples of a securing portion.

Earthquake-proof mats 13, which are examples of an adhesive member, are attached to bottom surfaces of the bottom plates 12. The earthquake-proof mats 13 are closely attached to the floor 1 so as to be removable from the floor 1, so that movement of the bottom plates 12 with respect to the floor 1 in the surface direction is restricted. Earthquake-proof gel mats made of an elastomeric resin, which is an example of an elastic resin material known in the art, may be adopted as the earthquake-proof mats 13. The earthquake-proof mats 13 are removable from the floor 1 and capable of restricting the movement of the bottom plates 12 with respect to the floor 1 in the surface direction by using friction between the earthquake-proof mats 13 and the floor 1 and the elasticity of the resin.

A plate-like vertical-oscillation restricting board 14, which is an example of a first restricting portion, is supported on the upper surfaces of the bottom plates 12. The vertical-oscillation restricting board 14 according to the first exemplary embodiment includes a plate-like vertical-oscillation restricting body portion 14*a* at a center portion thereof in the right-left directions. The vertical-oscillation restricting body portion 14*a* is disposed such that a lower surface thereof is adjacent to an upper surface of the lower nut 3*a*. The vertical-oscillation restricting board 14 includes an oblique portion 14*b* and a plate-like lower securement portion 14*c* on each of the right and left sides of the vertical-oscillation restricting body portion 14*a*. Each oblique portion 14*b* slants further downward as it extends further outward in the right-left directions, and each lower securement portion 14*c* extends outward in the right-left directions from a lower end of the oblique portion 14*b*.

The lower securement portion 14*c* has lower through-holes 14*d*, which vertically penetrate the lower securement portion 14*c* and correspond to the screw holes 12*a*.

The vertical-oscillation restricting body portion 14*a* has a lower shaft penetrating groove 14*e* that is formed in a U shape so as to extend from a rear portion to the front. The lower shaft penetrating groove 14*e* is an example of a first shaft penetrating portion. As illustrated in FIG. 4B, the length of the lower shaft penetrating groove 14*e* according to the first exemplary embodiment in the right-left directions is set so as to be larger than the outer diameter of the shaft portion 4 but smaller than the outer diameter of the lower nut 3*a*.

A lateral-oscillation restricting member 16, which is an example of a second restricting portion, is supported on upper surfaces of the lower securement portions 14*c*. The lateral-oscillation restricting member 16 according to the first exemplary embodiment includes a plate-like lateral-oscillation restricting body portion 16*a* at a center portion thereof in the right-left directions. As illustrated in FIGS. 3 and 4B, the lateral-oscillation restricting body portion 16*a* is positioned at a height that corresponds to the level at which the body nut 7 is attached so as to correspond to a bottom-portion-6-side end portion of the shaft portion 4. Side wall portions 16*b* that extend downward are formed on both sides of the lateral-oscillation restricting body portion 16*a*. An upper securement portion 16*c* that extends outward in the right-left directions is formed on a lower end of each side wall portion 16*b*.

Each upper securement portion 16*c* includes upper through-holes 16*d*, which vertically penetrate the upper securement portion 16*c* and correspond to the screw holes 12*a*.

An upper shaft penetrating groove 16*e*, which is an example of a second shaft-penetrating portion, is formed in a U shape in the lateral-oscillation restricting body portion 16*a* so as to extend from a rear end portion to the front. The upper shaft penetrating groove 16*e* according to the first exemplary embodiment are formed such that a gap between the upper shaft penetrating groove 16*e* and the body nut 7, which is attached to the bottom-surface-6-side end portion of the shaft portion 4, is smaller than a gap between the lower shaft penetrating groove 14*e* and the shaft portion 4. Particularly, in the first exemplary embodiment, the upper shaft penetrating groove 16*e* is in contact with the outer peripheral surface of the body nut 7 as illustrated in FIGS. 4B and 4C. Accordingly, there is no gap between the upper shaft penetrating groove 16*e* and the body nut 7, in contrast with the lower shaft penetrating groove 14*e* and the shaft portion 4, which have a gap therebetween.

In FIGS. 4A to 4C and 5, the vertical-oscillation restricting board 14 and the lateral-oscillation restricting member 16 are detachably supported by bolts 17, which are examples of a fastening member, via washers 18, which are examples of a loosening prevention member. The bolts 17 are screwed into the screw holes 12*a* through the through-holes 14*d* and 16*d*. Accordingly, the vertical-oscillation restricting board 14 and the lateral-oscillation restricting member 16 are mounted on the bottom plates 12 by screwing the bolts 17 and detached from the bottom plates 12 by unscrewing the bolts 17.

Figure 6A:
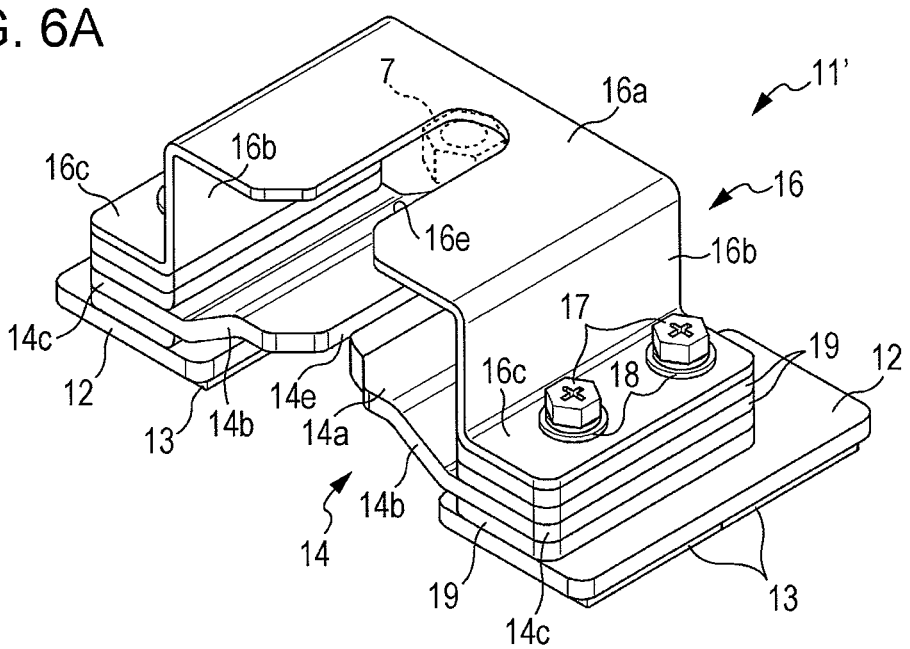
FIGS. 6A to 6C illustrate adjusting devices according to the first exemplary embodiment.
Figure 6B:
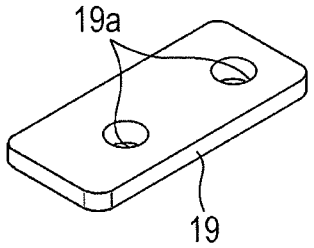
Figure 6C:
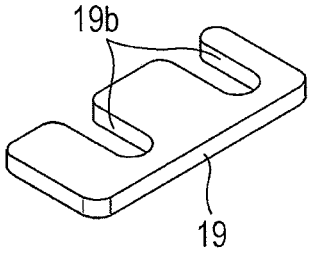

FIGS. 6A to 6C illustrate an adjusting device according to the first exemplary embodiment, FIG. 6A illustrates an exemplary state where the adjusting devices are attached to the fall prevention device according to the first exemplary embodiment, FIG. 6B is a perspective diagram of one of the adjusting devices, and FIG. 6C illustrates an adjusting device according to a modification of the adjusting device illustrated in FIG. 6B.

The height of the lower nut 3*a* or the body nut 7 with respect to the floor 1 may differ depending on several factors such as the type of the printer U or the environment in which the printer U is installed. To address this situation, plate-like spacers 19, which are examples of an adjusting device, are supported in the earthquake-proof bracket 11 according to the first exemplary embodiment as illustrated in FIG. 6. One plate-like spacer 19 is capable of being inserted between each bottom plate 12 and the vertical-oscillation restricting board 14 or between the vertical-oscillation restricting board 14 and the lateral-oscillation restricting member 16. Multiple plate-like spacers 19 that have a predetermined thickness are prepared in the first exemplary embodiment. By changing the number of spacers 19 to be inserted in accordance with the level of the lower nut 3*a* or the body nut 7, the vertical-oscillation restricting body portion 14*a* is capable of being disposed so as to be adjacent to and above the lower nut 3*a*, or the lateral-oscillation restricting body portion 16*a* is capable of being positioned at a height that corresponds to the level of the body nut 7.

FIG. 6A illustrates an exemplary state where one spacer 19 is inserted between each bottom plate 12 and the vertical-oscillation restricting board 14 and two spacers 19 are inserted between the vertical-oscillation restricting board 14 and the lateral-oscillation restricting member 16 on each side.

As illustrated in FIG. 6B, the spacer 19 according to the first exemplary embodiment has adjustment through-holes 19*a* that correspond to the screw holes 12*a*. As illustrated in FIG. 6C, however, the spacer 19 may have adjustment penetrating portions 19*b* each formed in a U-shaped groove so as to extend from an inner side portion in the right-left directions to a portion that corresponds to a corresponding screw hole 12*a* so that the spacer 19 is easily inserted from the outside in the right-left directions.

Operations of First Exemplary Embodiment

The earthquake-proof brackets 11 according to the first exemplary embodiment that are configured in the above manner are mounted on the feet 2 of the printer U, which is installed on the floor 1, from the outside in the front-rear directions. Specifically, the earthquake-proof brackets 11 are mounted on the feet 2 that are disposed on the front side of the printer U by moving the shaft penetrating grooves 14*e* and 16*e* next to the feet 2 from the front, and mounted on the feet 2 that are disposed on the rear side of the printer U by moving the shaft penetrating grooves 14*e* and 16*e* next to the feet 2 from the rear. As a result, the earthquake-proof brackets 11 are disposed so as to hold the printer U from the front and the rear.

The vertical-oscillation restricting board 14 of each earthquake-proof bracket 11 is positioned such that the vertical-oscillation restricting body portion 14*a* becomes adjacent to the upper surface of the lower nut 3*a* of a corresponding foot 2, and the lateral-oscillation restricting member 16 is positioned at a height that corresponds to the level at which the body nut 7 is attached to the bottom-surface-6-side end portion of the shaft portion 4.

Figure 7A:
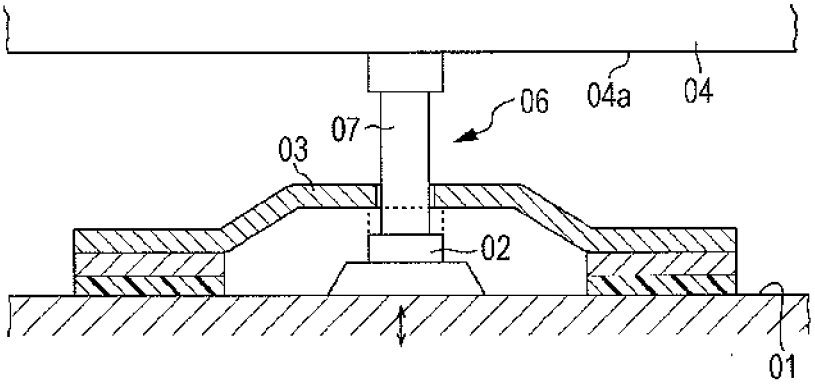
FIG. 7A PRIOR ART
FIGS. 7A to 7D illustrate operations of a fall prevention device of the related art and operations of the fall prevention device according to the first exemplary embodiment.
Figure 7B:
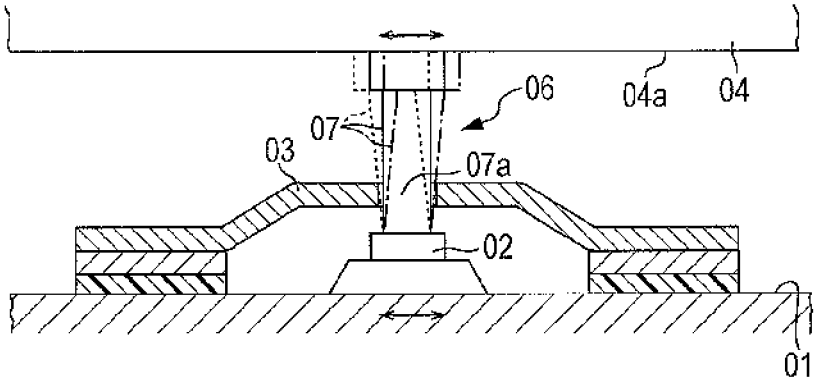
FIG. 7B PRIOR ART
Figure 7C:
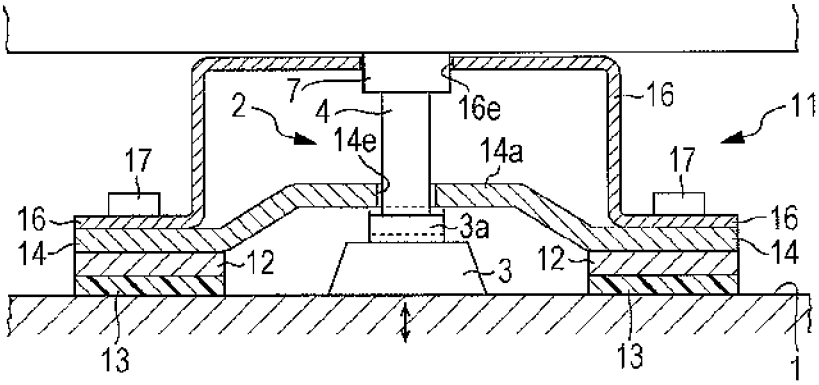
Figure 7D:
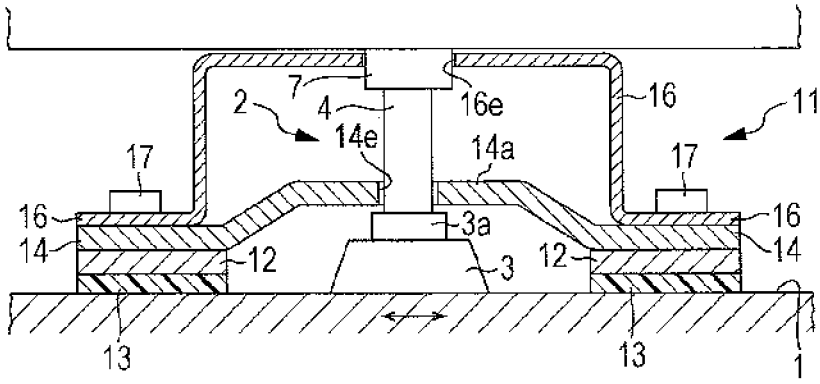

FIGS. 7A to 7D illustrate operations of a fall prevention device of the related art and operations of the fall prevention device according to the first exemplary embodiment. FIG. 7A illustrates a state of a fall prevention device of the related art when an installation surface oscillates vertically. FIG. 7B illustrates a state of the fall prevention device of the related art when the installation surface oscillates laterally. FIG. 7C illustrates a state of the fall prevention device according to the first exemplary embodiment when the installation surface oscillates vertically. FIG. 7D illustrates a state of the fall prevention device according to the first exemplary embodiment when the installation surface oscillates laterally.

As illustrated in FIG. 7A, in a fall prevention device according to the related art, when a floor 01 oscillates vertically or in the up-down directions, an upper surface of a lower nut 02 comes into contact with a lower surface of a vertical-oscillation restricting body portion 03, so that vertical movement of a device body 04 is restricted and the device body 04 is prevented from falling over. However, as illustrated in FIG. 7B, when the floor 01 oscillates horizontally or laterally, the device body 04 is more likely to oscillate to a large extent due to the following reason. A contact portion 07*a* at which the vertical-oscillation restricting body portion 03 and the shaft portion 07 of the foot 06 come into contact with each other serves as a fulcrum of a lever, the oscillation of the floor 01, which serves as an input point of a force, is amplified and transmitted to a bottom surface 04*a* of the device body 04, which serves as an output point of the force. When the device body 04 is subjected to such amplified oscillation, the securement of the bottom surface 04*a* of the device body 04 to the shaft portion 07 of the foot 06 may be released, or the shaft portion 07 may be bent. This may lead to a problem such as the device body 04 falling over.

In order to reduce the amplification of the horizontal oscillation, it is conceivable to dispose the vertical-oscillation restricting body portion 03 at a higher position. However, if the vertical-oscillation restricting body portion 03 is disposed at a higher position, the distance between the lower nut 02 and the vertical-oscillation restricting body portion 03 becomes longer and thus a vertical oscillation, as illustrated in FIG. 7A, may not be prevented by the vertical-oscillation restricting body portion 03. If, instead, a thicker vertical-oscillation restricting body portion 03 is formed, it may become more difficult to install the vertical-oscillation restricting body portion 03 due to an excessively increased weight, and cost may increase.

In contrast, in the case of the earthquake-proof brackets 11 according to the first exemplary embodiment, when the floor 1 oscillates vertically, the lower surface of the vertical-oscillation restricting body portion 14*a* suppresses the upper surface of the lower nut 3*a* to restrict a vertical oscillation. When the floor 1 oscillates in the right-left directions, leverage as illustrated in FIG. 7B does not occur since the body nut 7 and the lateral-oscillation restricting body portion 16*a* have been in contact with each other prior to the lower nut 3*a* and the vertical-oscillation restricting body portion 14*a* coming into contact with each other. Thus, the oscillation of the floor 1 is prevented from being amplified. Thus, in the earthquake-proof brackets 11 according to the first exemplary embodiment, an excessive load is less likely to be applied to the body nut 7 than in the case of the fall prevention device illustrated in FIG. 7B. Accordingly, the body nut 7 or the shaft portion 4 is less likely to be damaged and the printer U is prevented from falling over.

The earthquake-proof brackets 11 according to the first exemplary embodiment are disposed so as to hold the printer U from the front and the rear. The lateral-oscillation restricting body portions 16*a* of the earthquake-proof brackets 11 on the front and rear sides are in contact with the body nuts 7. For this reason, when the floor 1 moves toward the front, the lateral-oscillation restricting body portions 16*a* of the earthquake-proof brackets 11 on the front side restrict movement of the corresponding body nuts 7, and when the floor 1 moves toward the rear, the lateral-oscillation restricting body portion 16*a* of the earthquake-proof brackets 11 on the rear side restrict movement of the corresponding body nuts 7. In this manner, amplification of oscillation is reduced even when the floor 1 oscillates in the front-rear directions.

Moreover, since the spacers 19 are detachable from the earthquake-proof brackets 11 according to the first exemplary embodiment, the level of the vertical-oscillation restricting body portion 14*a* or the lateral-oscillation restricting body portion 16*a* is adjustable using the spacers 19 so as to correspond to the height of an existing foot 2 without a need to replace the existing foot 2 for the printer U or to prepare various types of earthquake-proof brackets for the existing feet 2 for the printer U. Thus, unnecessary cost increase is prevented.

In the case where maintenance work is performed on the printer U or a stationery tool or coin drops under the printer U, there arises a need to temporarily move the printer U. In this case, if the bottom plates 12 and the restricting members 14 and 16 of an earthquake-proof bracket are integrally formed, an operation to remove earthquake-proof mats 13 needs to be performed, which makes it laborious to move the printer U. In contrast, in the earthquake-proof bracket 11 according to the first exemplary embodiment, the vertical-oscillation restricting board 14 and the lateral-oscillation restricting member 16 are detachably supported by the bottom plates 12 via the bolts 17. For this reason, the printer U becomes movable when the restricting members 14 and 16 are detached while, for example, the bottom plates 12 are left on the floor 1. Thus, temporary movement of the printer U is more easily achieved.

Second Exemplary Embodiment

Figure 8:
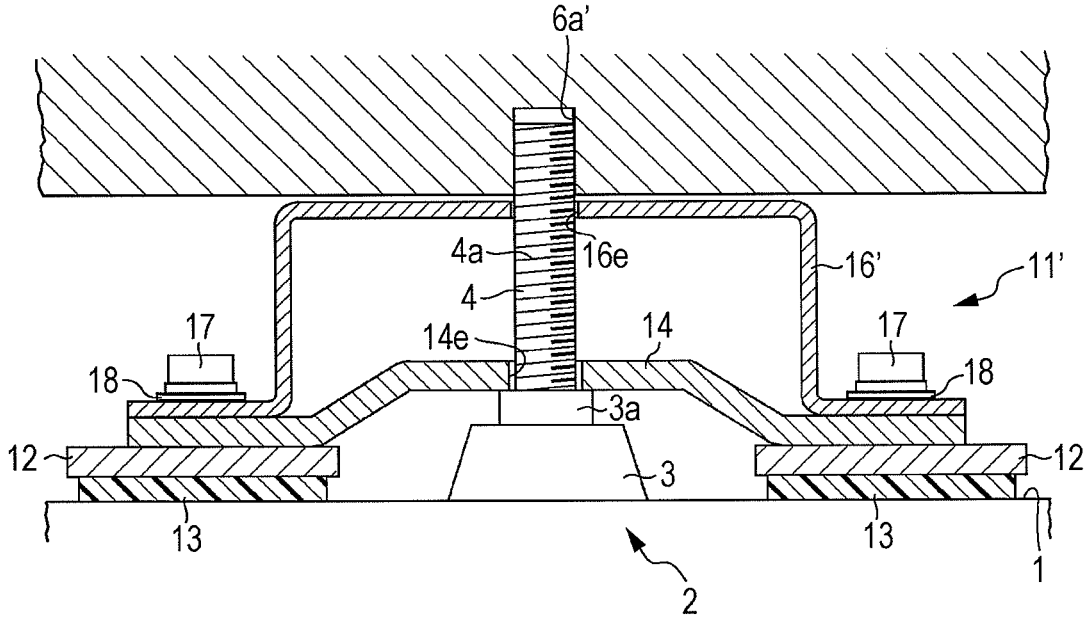
FIG. 8 illustrates a leg member and a fall prevention device according to a second exemplary embodiment and corresponds to FIG. 3 that illustrates the leg member and the fall prevention device according to the first exemplary embodiment.

FIG. 8 illustrates a leg member and a fall prevention device according to a second exemplary embodiment and corresponds to FIG. 3 that illustrates the leg member and the fall prevention device according to the first exemplary embodiment.

Now, a second exemplary embodiment of the present invention will be described. In the description of the second exemplary embodiment, components that correspond to the components according to the first exemplary embodiment are denoted by the same reference signs and are not described in detail.

The second exemplary embodiment is configured in substantially the same manner as the first exemplary embodiment except for points to be described below.

In FIG. 8, a printer U according to the second exemplary embodiment does not include the body nut 7. A thread groove is formed on the recessed portion 6*a*' of the printer U. The height of the printer U becomes adjustable by screwing a screw thread 4*a* of a shaft portion 4 of a foot 2 into the thread groove of the recessed portion 6*a'*.

Correspondingly, in an earthquake-proof bracket 11' according to the second exemplary embodiment, an upper shaft penetrating groove 16*e* of a lateral-oscillation restricting member 16' is formed such that a gap between the upper shaft penetrating groove 16*e* and a bottom-surface-6-side end portion of the shaft portion 4, not the body nut 7, is smaller than a gap between the lower shaft penetrating groove 14*e* and the shaft portion 4. Specifically, the width in the right-left directions of the upper shaft penetrating groove 16*e* is set to be equal to or larger than the outer diameter of the shaft portion 4 but smaller than the width in the right-left directions of the lower shaft penetrating groove 14*e*.

Operations of Second Exemplary Embodiment

In the earthquake-proof bracket 11' according to the second exemplary embodiment having the above configuration, when the floor 1 oscillates in the right-left directions, the upper shaft penetrating groove 16*e* comes into contact with the bottom-surface-6-side end portion of the shaft portion 4 prior to the shaft portion 4 and the lower shaft penetrating groove 16*e* coming into contact with each other at a position that is away downward from the bottom surface 6. Thus, like in the case of the first exemplary embodiment, the oscillation of the floor 1 is prevented from being amplified, and the printer U is thereby prevented from falling over.

Modifications

Although the exemplary embodiments of the present invention have been described above in detail, the present invention is not limited to the exemplary embodiments, but may be modified in various manners within a scope of the gist of the present invention described in the scope of claims. Modifications (H01) to (H08) of the present invention are exemplarily described below.

H01

In the exemplary embodiments, a printer is illustrated as an example of the image forming apparatus, but the present invention is not limited to this. The present invention is also applicable to other image forming apparatuses such as a copying machine or a facsimile machine (FAX). Although an image forming apparatus is illustrated as an example of the installation object, the present invention is not limited to this. The present invention is also applicable to any configuration having a foot, such as a cabinet, desk, shelf, storage rack, or furniture.

H02

In the exemplary embodiments, the vertical-oscillation restricting body portion 14*a* that indirectly restricts the oscillation of the base portion 3 via the lower nut 3*a* that is supported by the base portion 3 is exemplarily illustrated. However, the present invention is not limited to this. The vertical-oscillation restricting body portion 14*a* may directly come into contact with the upper surface of the base portion 3. In this case, the lower nut 3*a* may be excluded. Instead, the width of the lower shaft penetrating groove 14*e* may be increased to such a degree that the lower nut 3*a* is accommodated in the lower shaft penetrating groove 14*e* while having a gap between the lower nut 3*a* and the lower shaft penetrating groove 14*e*.

H03

In the exemplary embodiments, the lateral-oscillation restricting body portion 16*a* that indirectly restricts the oscillation of the shaft portion 4 in the right-left directions via the body nut 7 is exemplarily illustrated. However, the present invention is not limited to this. The lateral-oscillation restricting body portion 16*a* may directly come into contact with the shaft portion 4. Here, the body nut 7 may be embedded within the bottom surface 6, or may be excluded.

H04

In the exemplary embodiments, the upper shaft penetrating groove 16*e* of the lateral-oscillation restricting body portion 16*a* is in contact with the body nut 7, but the present invention is not limited to this. The upper shaft penetrating groove 16*e* and the body nut 7 may have a gap therebetween without being in contact with each other as long as the body nut 7 and the upper shaft penetrating groove 16*e* are capable of coming into contact with each other at the time of oscillation prior to the lower shaft penetrating groove 14*e* coming into contact with the shaft portion 4.

H05

In the exemplary embodiments, it is desirable that the restricting members 14 and 16 be detachable from the bottom plates 12, but may be made undetachable by a soldering operation or other operations.

H06

In the exemplary embodiments, it is desirable that the earthquake-proof bracket 11 be made removable or detachable from the floor 1 by using the earthquake-proof mat 13. However, the present invention is not limited to this. For example, the earthquake-proof bracket 11 may be secured to the floor 1 by using an anchor bolt, an adhesive agent, or the like, or may have other configurations.

H07

In the exemplary embodiments, it is desirable that the height of the earthquake-proof bracket 11 be made adjustable by using the spacer 19. However, the present invention is not limited to this. For example, a structure may be adopted that is vertically slidable through a long hole and the length thereof may be made adjustable. Alternatively, earthquake-proof brackets having various heights may be formed in accordance with the heights of the feet.

H08

In the exemplary embodiments, the floor is exemplarily illustrated as an example of the installation surface. However, the present invention is not limited to this, and may be applicable to any installation surface such as a top surface of a desk.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fall prevention device configured to prevent an installation object from falling over by supporting a leg member including a base portion and a shaft portion when an installation surface oscillates, the base portion being in contact with the installation surface, the shaft portion connecting the base portion and a bottom portion of the installation object to each other and having a diameter that is smaller than a diameter of the base portion, the fall prevention device comprising:

a support member provided on the installation surface;

a first restricting member provided on the support member and comprising a first restricting body portion disposed above an upper surface of the base portion, the first restricting body portion comprising a first shaft-penetrating portion through which the shaft portion penetrates;

a second restricting member disposed above the first restricting member, and comprising a second shaft-penetrating portion through which the shaft portion penetrates; and an adjustable member attached to the shaft portion, wherein a top surface of the first restricting member does not contact to a bottom surface of the second restricting member at a position near the first shaft-penetrating porting of the first restricting member and the second shaft-penetrating portion of the second restricting member, and wherein a gap disposed between the second shaft-penetrating portion and the adjustable member along an extending direction of the installation surface is smaller than a gap disposed between the first shaft-penetrating portion and the shaft portion.

2. The fall prevention device according to claim 1, wherein each of the first restricting member and the second restricting portion is detachably attached to each other and to the support member.

3. The fall prevention device according to claim 1, further comprising:

an adhesive member that is provided between the support member and the installation surface, and configured to reduce movement of the support member with respect to the installation surface.

4. The fall prevention device according to claim 2, further comprising:

an adhesive member that is provided between the support member and the installation surface, and configured to reduce movement of the support member with respect to the installation surface.

5. The fall prevention device according to claim 1, wherein the base portion is configured to contact the first restricting body portion in response to a vertical movement of the installation surface.

6. The fall prevention device according to claim 1, wherein the second restricting member comprises a second restricting body portion extending in the direction substantially parallel with the installation surface, and wherein the second shaft-penetrating portion is provided on the second restricting body portion.

7. The fall prevention device according to claim 1, wherein the support member comprises at least two support plates, and wherein each of the first and second restricting members connects the at least two support plates.

8. A fall prevention device configured to prevent an installation object from falling over by supporting a leg member including a base portion and a shaft portion when an installation surface oscillates, the base portion being in contact with the installation surface, the shaft portion connecting the base portion and a bottom portion of the installation object to each other and having a diameter that is smaller than a diameter of the base portion, the fall prevention device comprising:

a support member provided on the installation surface;

a first restricting member provided on the support member and comprising a first restricting body portion disposed above an upper surface of the base portion, the first restricting body portion comprising a first shaft-penetrating portion through which the shaft portion penetrates, a width of the first shaft-penetrating portion being smaller than a width of the base portion;

a second restricting member disposed above the first restricting member, and comprising a second shaft-penetrating portion through which the shaft portion penetrates; and an adjustable member attached to the shaft portion, wherein a top surface of the first restricting member does not contact to a bottom surface of the second restricting member at a position near the first shaft-penetrating porting of the first restricting member and the second shaft-penetrating portion of the second restricting member, and a gap disposed between the second shaft-penetrating portion and the adjustable member along an extending direction of the installation surface is smaller than a gap disposed between the first shaft-penetrating portion and the shaft portion.

9. The fall prevention device according to claim 8, wherein each of the first restricting member and the second restricting member is detachably attached to each other and to the support member.

10. The fall prevention device according to claim 8, further comprising:

an adhesive member that is provided between the support member and the installation surface, and configured to reduce movement of the support member with respect to the installation surface.

11. The fall prevention device according to claim 9, further comprising:

an adhesive member that is provided between the support member and the installation surface, and configured to reduce movement of the support member with respect to the installation surface.

12. The fall prevention device according to claim 8, wherein the base portion is configured to contact the first restricting body portion in response to a vertical movement of the installation surface.

13. The fall prevention device according to claim 8, wherein the second restricting member comprises a second restricting body portion extending in the direction substantially parallel with the installation surface, and wherein the second shaft-penetrating portion is provided on the second restricting body portion.

14. The fall prevention device according to claim 8, wherein the support member comprises at least two support plates, and wherein each of the first and second restricting members connects the at least two support plates.

15. The fall prevention device according to claim 1, wherein the base portion is in contact with the installation surface upon completion of assembly of the fall prevention device.

16. The fall prevention device according to claim 8, wherein the base portion is in contact with the installation surface upon completion of assembly of the fall prevention device.

17. The fall prevention device according to claim 1, wherein a portion of the top surface of the first restricting member and a portion of the bottom surface of the second restricting member not contacting each other overlap each other along a direction extending perpendicular to the installation surface.

18. The fall prevention device according to claim 8, wherein a portion of the top surface of the first restricting member and a portion of the bottom surface of the second restricting member not contacting each other overlap each other along a direction extending perpendicular to the installation surface.

* * * * *